US006033139A

United States Patent [19]

Dutcher

[11] Patent Number: 6,033,139

[45] Date of Patent: Mar. 7, 2000

[54] MULTIPLE PEN HOLDER AND DRAWING AID

[76] Inventor: David S. Dutcher, 9262 Santenay Way, Sacramento, Calif. 95829

[21] Appl. No.: 09/173,262

[22] Filed: Oct. 15, 1998

[51] Int. Cl.[7] ..... B43K 27/04

[52] U.S. Cl. ..... 401/35; 401/131

[58] Field of Search ..... 401/131, 35, 34; 33/41.4

[56] References Cited

U.S. PATENT DOCUMENTS

| | | | |
|---|---|---|---|
| D. 342,968 | 1/1994 | Mainke | D19/55 |
| D. 368,737 | 4/1996 | Dunn et al. | 401/35 X |
| 724,445 | 4/1903 | Decker | 401/35 |
| 893,009 | 3/1908 | Gee | 401/35 X |
| 2,964,812 | 12/1960 | Cook | 401/131 X |
| 3,164,906 | 1/1965 | Andaloro | 33/41 |
| 3,166,847 | 1/1965 | Marino | 33/41 |
| 3,391,432 | 7/1968 | DuRocher | 401/35 X |
| 3,750,292 | 8/1973 | Dodge | 33/41.4 |
| 4,120,595 | 10/1978 | Moreno | 401/35 |
| 4,238,161 | 12/1980 | Morohashi | 401/35 |
| 4,355,726 | 10/1982 | Mutschler | 211/69.5 |
| 4,826,338 | 5/1989 | Kilpatrick | 401/35 |
| 4,865,285 | 9/1989 | Gaggianese | 401/131 X |
| 5,017,034 | 5/1991 | Stary et al. | 401/35 |

FOREIGN PATENT DOCUMENTS

| | | | |
|---|---|---|---|
| 2658516 | 6/1978 | Germany | 33/41.4 |

*Primary Examiner*—David J. Walczak
*Attorney, Agent, or Firm*—Dennis W. Beech

[57] ABSTRACT

The multiple pen holder and drawing aid is a generally rectangular device or casing which has holes in one side and retaining elements in the casing to hold drawing instruments such as dry erase markers, pens, pencils and similar instruments. The retaining elements and holes are arranged such that the drawing instruments are retained in the casing with the tip ends extended outwardly through the holes. The user may then hold the drawing aid in one hand to use to draw multiple parallel lines on a drawing surface. The casing has a top casing element and bottom casing element which are hinged relative to each other and latched for closure. Thus the casing may be opened in a clam shell manner for insertion and removal of drawing instruments.

9 Claims, 3 Drawing Sheets

MULTIPLE PEN HOLDER AND DRAWING AID

BACKGROUND OF THE INVENTION

1. Field of the Invention

This invention relates to devices used to draw or write multiple lines on paper, display boards and the like. The present invention provides a simple holder to retain multiple drawing pens, pencils and other instruments for use in drawing parallel lines on the selected drawing medium.

2. Description of Related Art

There are various devices currently used for drawing parallel lines with the most commonly known being the aids used by draftspersons. Many plastic templets exist which have apertures formed therein for use in inserting the drawing point of a pen or pencil which device must be held by the user. Using such templets usually requires moving a pen from aperture to aperture for purposes of parallel line drawing and use of a ruler or straight edge to keep each line parallel when drawing.

Multiple tip pens have been designed which may be used to draw two parallel lines. The pin tips and ink are contained in a single casing which may be held in the hand. Such pens may contain pen tips having different spacing depending on the drawn line spacing desired. Extending or expanding such a system as disclosed in U.S. Pat. No. 4,826,338 may be feasible, but beyond the two pen tip design would be complicated to manufacture and maintain. A multi-pen version of a drawing device is disclosed in U.S. Pat. No. 4,826,338. However, by its design it is limited to small drawing instruments such as ball point pen refill elements as illustrated in the figures. This expanding problem would be particularly true if wide spacing of lines is desired such as used for a wall mounted drawing or chalk board.

The present invention is preferably a holder formed of two half casings which close together to retain a drawing instrument such as a dry erase marker. The aid is generally rectangular with provision to hold multiple drawing instruments for drawing the desired number of parallel lines. By using existing drawing instruments it is easy to replace pens and thereby pen tips when they are not working properly. Also the structure of the aid is simple to manufacture as no ink or other lining component is required to be stored directly in the aid. With multiple pens installed the drawing aid may be held in the hand and the multiple tips of the pens moved across a writing surface to create parallel lines.

SUMMARY OF THE INVENTION

One object of the present invention is provision for retaining multiple drawing instruments in a drawing aid to facilitate drawing of multiple parallel lines. Another object is to allow storage of the drawing aid with drawing instruments installed.

In accordance with the description presented herein, other objectives of this invention will become apparent when the description and drawings are reviewed.

DESCRIPTION OF THE PREFERRED EMBODIMENT

Figure 2:
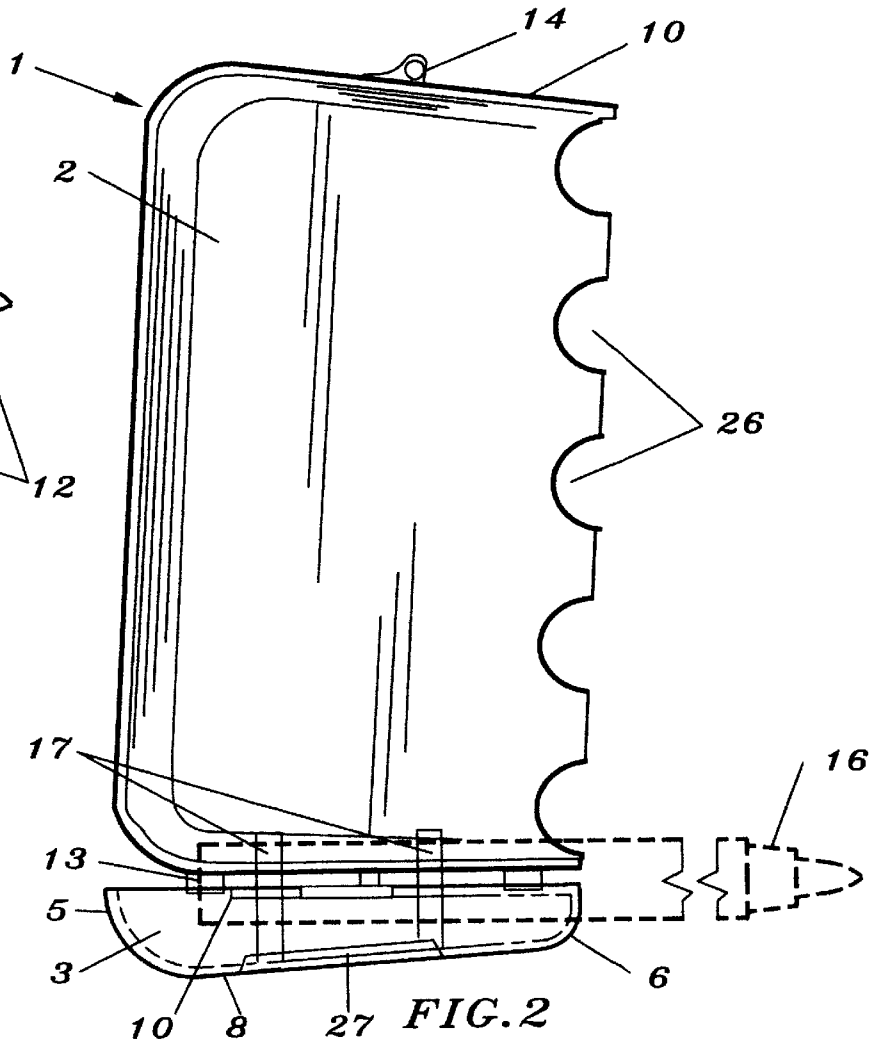
FIG. 2 illustrates a side elevation view of the drawing aid partially opened for insertion and removal of drawing instruments.

The multiple pen holder and drawing aid is a generally rectangular casing or box comprised of two half casings joined together. The two half casings are hinged together on one adjacent side and have a latching mechanism on the opposite adjacent side. Apertures are formed in the front side such that the drawing instruments protrude from the drawing aid. Retaining members are positioned in one or both half casings to retain the drawing instruments in the drawing aid.

Figure 1:
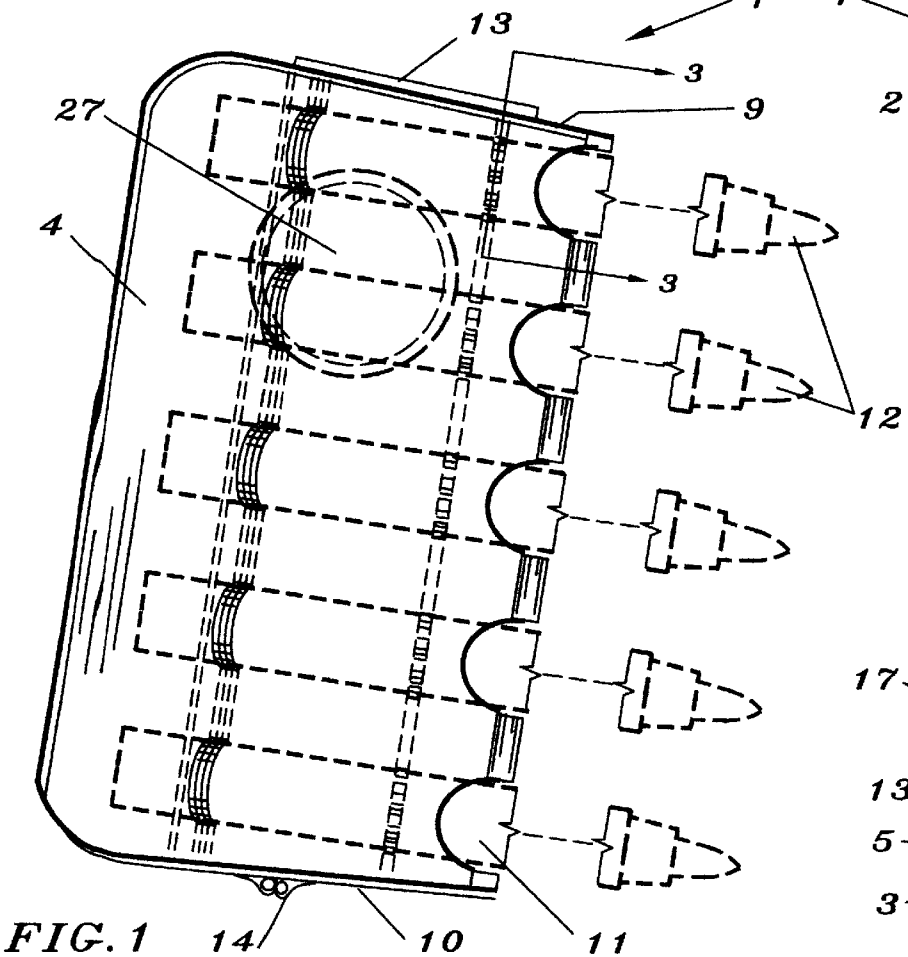
FIG. 1 illustrates a top plan view of the drawing aid.
Figure 6:
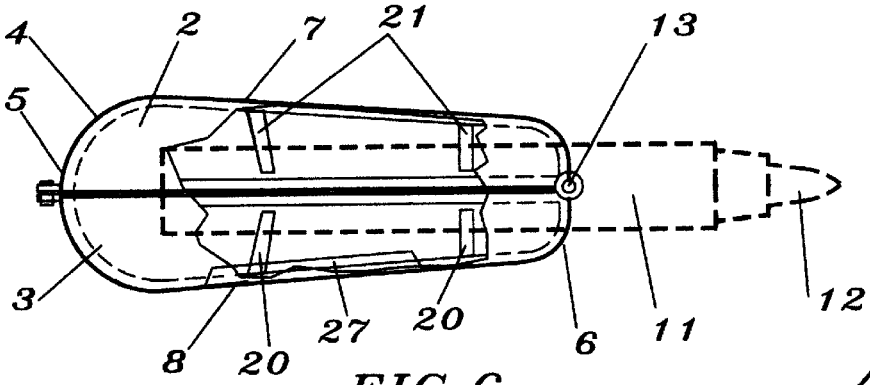
FIG. 6 illustrates a side elevation view of the drawing aid closed with alternate location of hinge and hatch.

Referring to FIGS. 1, 2 and 6, the multiple pen holder and drawing aid (1) is generally rectangular in shape having a top casing (2) and a bottom casing (3). In the preferred embodiment the casing (4) from back side (5) to front side (6) has a gradual taper relative to the top side (7) and bottom side (8) to aid in gripping the drawing aid (1) for use in drawing lines. The casing (4) from back side (5) to front side (6) may also have a gradual taper to provide a slight incline downward if the drawing aid is stored on a side (9,10). The incline position with markers (11), pens or the like causes flow of ink toward the tip end (12) to retard tip drying.

The casing (4) has a hinge (13) attaching adjacent side (9) edges of the top casing (2) and bottom casing (3). On the opposite adjacent side (10) edges a latch (14) allows for opening and closing of the casing (4). The front side (6) has multiple apertures (15) spaced apart to provide the desired distance between the parallel lines to be drawn on a drawing or writing surface. The apertures (15) are formed as approximately semicircular or elliptic slots (26) in the front side (6) of the top casing (2) and bottom casing (3). The apertures (15) may be shaped to securely hold the drawing instruments (16) are may be relatively open to accommodate a variety of sizes of drawing instruments (16). It has been found that a casing (4) size which captures approximately one third of the drawing instrument (16) and has two thirds protruding from the casing (4) works well.

Figure 4:
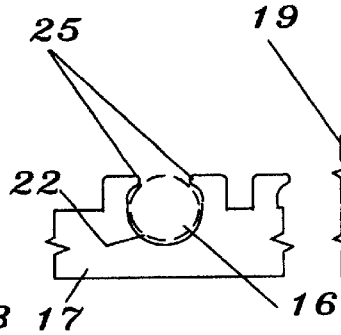
FIG. 4 illustrates a partial elevation view of the friction retainer for the drawing instrument.

Two retaining members (17) are attached in the bottom casing (3) to hold the drawing instruments (16). As illustrated in FIG. 4 the preferred retaining members (17) are friction fit devices. The drawing instruments (16) are forced between prongs (25) to be held in retaining member (17).

Figure 3:
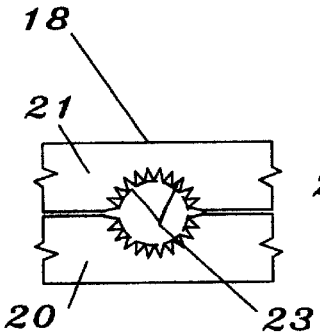
FIG. 3 illustrates a partial elevation view of a second alternate embodiment retainer.
Figure 5:
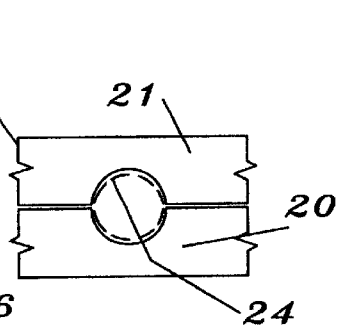
FIG. 5 illustrates a partial elevation view of an alternate embodiment retainer.

Referring to FIGS. 3 and 5 alternate retaining members (18,19) illustrate forms which may accommodate more variability in the diameter of a drawing instrument (16). In alternate retaining member (18) there is a first retaining element (20) attached in the bottom casing (3) and a second retaining element (21) in the top casing (2). The retainer slots (22) are approximately semicircular in shape and have flexible tabs (23) which allow variable size drawing instruments (16). The second alternate retaining member (19) is similarly constructed, but substitutes an elastic insert element (24) in place of tabs (23). The retaining members illustrated in FIGS. 3 through 5 may be used in various combinations in the drawing aid (1) depending on the drawing instrument (16) to be retained.

With multiple drawing instruments (16) in the drawing aid (1), as illustrated in FIG. 1, the drawing aid (1) may be held in one hand and the drawing instruments (16) moved across a drawing surface to create multiple parallel lines. The drawing aid (1) may be stored with dry erase markers (11) installed as illustrated in FIG. 1 such that the drawing aid (1) rests on a side (9 or 10). This position provides flow of ink to the tip end (12) of the markers (11). The drawing aid (1) may also have a magnet (27) attached to or formed in the casing (4). By this means the drawing aid (1) may be stored by magnetic attachment to a metal based marking board (not shown) or other magnetic attracting structures.

While the preferred embodiment has been illustrated with five positions for drawing instruments (16) it is obvious more or less positions may be provided in a particular drawing aid (1).

Figure 7:
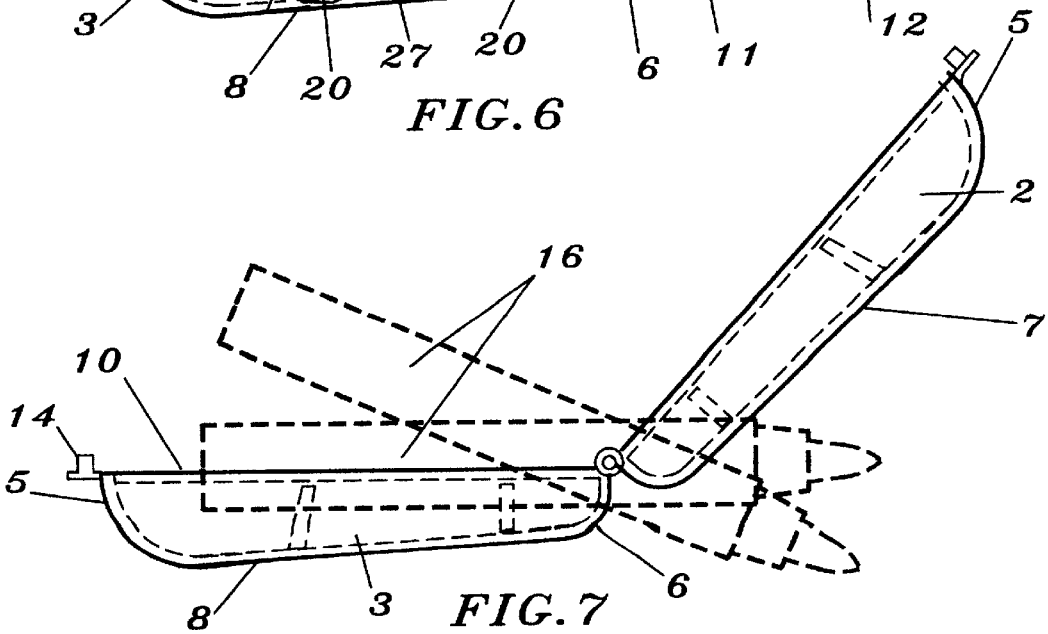
FIG. 7 illustrates a side elevation view of the alternate embodiment partially opened for insertion and removal of drawing instruments.
Figure 8:
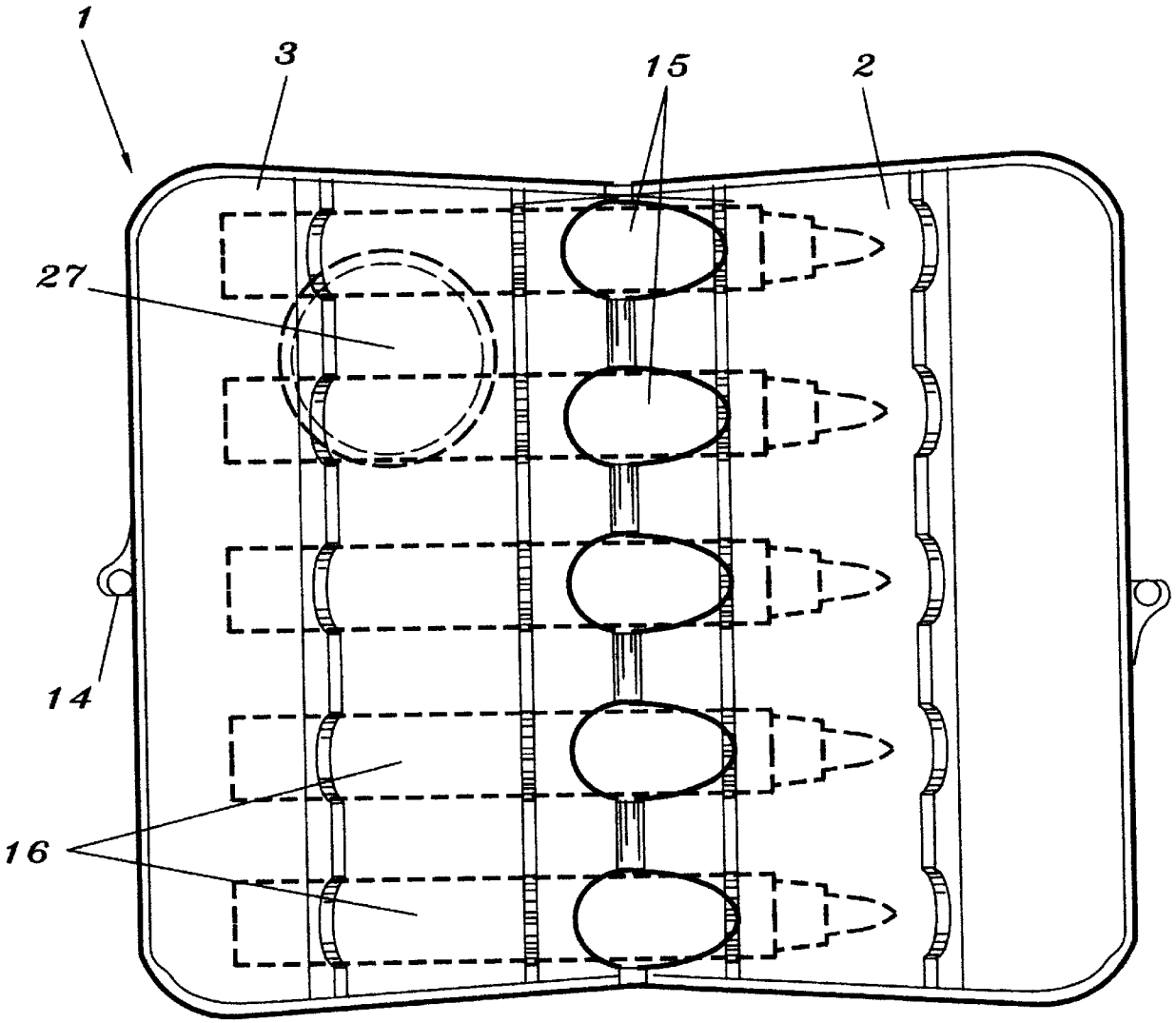
FIG. 8 illustrates a top plan view of the alternate embodiment fully opened.

Referring to FIGS. 6 through 8, an alternate embodiment is illustrated with the casing (4) hinged at the front side (6) and latched at the back side (5). The overall shape is the same for this embodiment. However, adjustments in the apertures (15) may be necessary to accommodate the insertion and removal of drawing instruments (16). obviously the casing may be hinged at the back side (5) and latched at the front side (6).

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A device for holding a plurality of drawing instruments for use in drawing parallel lines comprising:

a top casing element joined to a bottom casing element by a means for attachment to form a casing;

the casing having a back side, a front side, a top side, a bottom side and two sides;

the front side of the casing having a plurality of apertures therein with each aperture formed from the top casing element on the front side having a plurality of slots and the bottom casing element on the front side having a plurality of mating slots;

the casing is generally rectangular in shape and has a gradual taper from the back side to the front side as observed from an elevation view thereof and as observed from a top view thereof; and two retaining members contained in and attached to the casing positioned for receiving and retaining a plurality of drawing instruments which at a tip end extend outwardly from the casing through the apertures.

2. The device as in claim 1 wherein the means for attachment is a hinge attached at one adjacent side to the top casing element and the bottom casing element and a latch attached at the opposite adjacent side of the top casing element and the bottom casing element.

3. The device as in claim 1 wherein the means for attachment is a hinge attached at the front side to the top casing element and the bottom casing element and a latch attached at the back side to the top casing element and the bottom casing element.

4. The device as in claim 1 wherein the means for attachment is a hinge attached at the back side to the top casing element and the bottom casing element and a latch attached at the front side to the top casing element and the bottom casing element.

5. The device as in claim 1 wherein the retaining members are attached to the bottom side and have a plurality of retaining slots with a pair of prongs for receiving and retaining the drawing instruments.

6. The device as in claim 1 wherein the retaining members have a plurality of first retaining elements attached to the bottom side and a plurality of second retaining elements attached to the top side wherein the first retaining elements and the second retaining elements have formed therein a plurality of mating retaining slots for receiving and retaining the drawing instruments when the casing is closed.

7. The device as in claim 6 wherein each mating retaining slot has a plurality of flexible tabs formed therein.

8. The device as in claim 6 wherein each mating retaining slot has an elastic insert element attached therein.

9. The device as in claim 1 wherein the casing having a magnet as a part thereof located away from the center of gravity toward the back side.

* * * * *